US011009321B2

(12) United States Patent
Buys

(10) Patent No.: US 11,009,321 B2
(45) Date of Patent: May 18, 2021

(54) LESS-LETHAL MUNITIONS

(71) Applicant: BYRNA TECHNOLOGIES INC., Wakefield, MA (US)

(72) Inventor: Andre Johann Buys, Pretoria (ZA)

(73) Assignee: BYRNA TECHNOLOGIES INC., Wakefield, MA (US)

( * ) Notice: Subject to any disclaimer, the term of this patent is extended or adjusted under 35 U.S.C. 154(b) by 0 days.

(21) Appl. No.: 16/685,433

(22) Filed: Nov. 15, 2019

(65) Prior Publication Data

US 2020/0158481 A1 May 21, 2020

Related U.S. Application Data

(60) Provisional application No. 62/767,802, filed on Nov. 15, 2018.

(51) Int. Cl.
*F42B 7/08* (2006.01)
*F42B 7/10* (2006.01)
*F42B 14/06* (2006.01)

(52) U.S. Cl.
CPC ..... *F42B 7/08* (2013.01); *F42B 7/10* (2013.01); *F42B 14/062* (2013.01)

(58) Field of Classification Search
CPC ..... F42B 7/08; F42B 7/10; F42B 5/03; F42B 5/073; F42B 14/06; F42B 14/061; F42B 14/062; F42B 14/064; F42B 14/067; F42B 14/068
USPC ..... 102/502, 450
See application file for complete search history.

(56) References Cited

U.S. PATENT DOCUMENTS 3,062,145 A * 11/1962 Morgan ..... F42B 7/10 102/436
3,650,213 A * 3/1972 Abbott ..... F42B 5/02 102/436
4,718,348 A * 1/1988 Ferrigno ..... F42B 7/04 102/439
5,175,394 A * 12/1992 Sowash ..... F42B 14/064 102/522
6,164,209 A * 12/2000 Best ..... F42B 5/307 102/439
6,213,024 B1 * 4/2001 Jasper, Jr. ..... F42B 12/36 102/502
6,250,226 B1 * 6/2001 Leichter ..... F42B 12/50 102/367
7,640,860 B1 * 1/2010 Glover ..... F42B 12/367 102/457
2005/0188886 A1 * 9/2005 Vasel ..... F42B 6/10 102/502

(Continued)

*Primary Examiner* — John Cooper
(74) *Attorney, Agent, or Firm* — Nath, Goldberg & Meyer; Joshua B. Goldberg

(57) ABSTRACT

This invention relates to less-lethal munitions. More particularly, the invention relates to a wad and a less-lethal round of ammunition adapted for use with a conventional firearm, which less-lethal shell enables the firearm to propel less-lethal projectiles therefrom. According to a first aspect of the invention there is provided a wad operatively received within an ammunition casing, the wad comprising a substantially disc-shaped base; and a plurality of tabs extending from the base defining a receiving zone therebetween, with at least some of the tabs provided with an inwardly projecting formation for urging against a projectile operatively received within the receiving zone.

12 Claims, 9 Drawing Sheets

(56) References Cited

U.S. PATENT DOCUMENTS

| | | | | |
|---|---|---|---|---|
| 2006/0011090 | A1* | 1/2006 | Vasel | F42B 5/16<br>102/512 |
| 2009/0050127 | A1* | 2/2009 | Wygant | F42B 6/00<br>124/56 |
| 2013/0337949 | A1* | 12/2013 | Macy | F41B 11/55<br>473/577 |
| 2015/0144018 | A1* | 5/2015 | Buys | F42B 12/40<br>102/502 |

* cited by examiner

LESS-LETHAL MUNITIONS

INTRODUCTION AND BACKGROUND

This invention relates to less-lethal munitions. More particularly, the invention relates to a wad and a less-lethal round of ammunition adapted for use with a conventional firearm, which less-lethal shell enables the firearm to propel less-lethal projectiles therefrom.

The use of lethal force by law enforcement agencies or personnel, private security companies, or even civilians as defensive or self-defensive measures is generally met with dissent. Internationally, legislative and regulatory requirements generally tend to dissuade the use of lethal force, and instead tends towards defensive regimes in the less-lethal sphere.

For example, currently in the USA, proposed legislative changes seek to require law enforcement personnel to use less-lethal force to incapacitate an attacker, before resorting to lethal force.

In most cases, the effective range or accuracy of known or currently available less-lethal devices render these devices ineffective. Best known examples include tasers and lachrymatory substances such as mace (also known as pepper spray). Tasers are accurate and effective to a maximum of 15 feet. This falls within the currently permissible "shoot to kill" range of 21 feet. Consequently, the current less-lethal devices' inefficiency, inaccuracy and in-utility seem to render adherence to the proposed legislative provisions impractical. In some cases, the use of tasers are viewed as excessive use of force, and annually, as many as a thousand "wrongful deaths" are attributable to the use of tasers in an attempt to use less-lethal force by law enforcement agencies.

Also known is the use of rubber projectiles typically fired from shotguns. For this purpose, shotgun shells, witted with so-called "wads" are provided. The wads are provided within shell casings of the shotgun shell to shield the rubber projectiles from the powder and primer. The wads typically comprise substantially disc-shaped plastic formations. In some cases, a number of tabs extend from the disc-shaped formations to define a receiving portion within which the rubber projectiles are received. Manufacturing imperfections render rubber projectiles inaccurate. The rubber projectiles are also known to cause serious injury, or even in severe cases, death.

As an alternative, less-lethal devices or launchers (similar to paintball guns) propelling projectiles by releasing compressed gas are often used.

The projectiles are filled with lachrymatory substances, such as mace. Spherical projectiles are notoriously inaccurate.

To combat the inaccuracy of the spherical projectiles, elongate less-lethal projectiles have been developed. U.S. Pat. No. 9,746,297 B2 in the name of the current inventor describes a less-lethal projectile comprising an elongate body, a plurality of fins radially spaced about a rear portion of the body to impart spin of the projectile in flight, and an annular airfoil surrounding the fins, to improve the aerodynamic properties of the projectiles, whilst simultaneously facilitating stacking of the projectiles in a magazine. These less-lethal projectiles are manufactured from polymeric materials.

Both the traditional spherical projectiles and the newer elongate projectiles are too fragile to generally be associated with gun-powder burning weapons.

A need exists, especially within the field of riot and crowd-control, for less-lethal munitions that can be used to incapacitate persons without causing unnecessary harm, the munitions being compatible to be used with launchers gunpowder-firing configuration.

For the purpose of the current disclosure, a surface described as "semi-spherical" will be understood to refer to a surface which would follow a contour of at least a portion of a substantially spherical object brought in contact therewith, irrespective of the size of the semi-spherical surface relative to the spherical object.

OBJECT OF THE INVENTION

It is an object of the present invention to provide less-lethal munitions with which the applicant believes the aforementioned disadvantages may at least be alleviated or which may provide useful alternatives for the known less-lethal munitions.

SUMMARY OF THE INVENTION

According to a first aspect of the invention there is provided a wad operatively received within an ammunition casing, the wad comprising:

a substantially disc-shaped base; and a plurality of tabs extending from the base defining a receiving zone therebetween, with at least some of the tabs provided with an inwardly projecting formation for urging against a projectile operatively received within the receiving zone.

The wad may comprise at least two tabs. Preferably, the wad may comprise at least four tabs. Typically, the wad comprises six tab, but may ultimately comprise any amount of tabs ranging from a single tab, to ten tabs. The tabs may be integrally formed with the disc shaped base. The tabs may each comprise a flat face at an end opposite the base.

The tabs may be displaceable between an inward configuration and an outward configuration, and may comprise, towards the base, a narrowed portion to facilitate displacement between the inward and outward configurations. The tabs may be biased towards the outward configuration.

The inwardly projecting formation may comprise a first portion which may be shaped similarly to a profile of an intermediate or rear portion of the projectile, so that in use, when the tabs are configured in the inward configuration, the first portions of the plurality of tabs may urge against the intermediate or rear portion of the projectile so that when the wad is forced from the casing, a distributed load is transferred to the intermediate or rear portion of the body of the projectile.

The inwardly projecting formation may furthermore comprise a second portion which may be shaped similarly to a profile of a front portion of the projectile, so that in use, the second portions of the plurality of tabs may urge against the front portion of the projectile to inhibit the projectile from being displaced axially relative to the wad when the tabs are configured in the inward configuration.

When the tabs are configured in the inward configuration, the first portions may collectively define a substantially tear-shaped receiving zone for receiving a projectile having an elongate body. Simultaneously, the second portions may collectively define a substantially semi-spherical receiving zone for receiving one of i) a semi-spherical cap provided over the elongate body to define a cavity; and ii) a spherical projectile received by the elongate body of the projectile.

Alternatively, when the tabs are configured in the inward configuration, the first portions may collectively define a substantially semi-spherical receiving zone for so that the first and second portions collectively define a substantially spherical receiving zone for receiving a substantially spherical projectile. Furthermore, tabs may comprise a second inwardly projecting formation comprising a third and fourth portion for defining a second substantially spherical receiving zone for receiving a second substantially spherical projectile within the wad.

The wad may be manufactured from a polymeric material, such as a plastics material. The polymeric material may be water soluble and biodegradable.

The ammunition casing may comprise a shotgun shell case, which forms part of a shotgun shell. The shotgun shell may furthermore comprise a head portion, at least partially filled with a propellant. The head portion may be provided with a primer for operatively igniting the propellant.

Alternatively, the ammunition case may form part of a round of conventional firearm ammunition, including small arms, bullets, cartridges or shells.

According to a second aspect of the invention there is provided a round of less lethal ammunition comprising:

a casing defining a substantially cylindrical inner cavity;

a wad according to the first aspect of the invention, projecting at least partially into the substantially cylindrical inner cavity; and a projectile received within the receiving zone of the wad.

A front portion of the casing may be formed to retain the wad within the casing. The front portion may be folded over and may urge against the flat faces of the tabs to retain the wad within the casing.

The projectile may comprise an elongate body manufactured from a polymer; a capsule towards a front end of the body, the capsule for receiving a substance; a plurality of fins helically arranged relative to the body to cause the projectile operatively, to spin along a longitudinal axis of the body; and an annular airfoil at the rear of the body and surrounding at least part of the fins.

The capsule may comprise a conventional spherical projectile received by a suitably shaped front portion of the body. Alternatively, a cap may be provided over the front end of the body, so that a capsule is formed between the body and the cap.

Alternatively, the projectile may comprise a conventional substantially spherical projectile.

The wad may be shaped to receive a first and second projectile within the casing.

The ammunition casing may comprise a shotgun shell case, which forms part of a shotgun shell. The shotgun shell may furthermore comprise a head portion, at least partially filled with gunpowder. The head portion may be provided with a primer for operatively igniting the gunpowder.

Alternatively, the ammunition case may form part of a round of conventional firearm ammunition, such as small arms, bullets, cartridges or shells.

According to a third aspect of the invention there is provided a round of less-lethal ammunition, comprising:

a casing defining a substantially cylindrical inner cavity;

a wad; and a projectile received within the substantially cylindrical inner cavity, the projectile comprising a helical formation to operatively cause the projectile to spin in flight.

The wad may comprise a substantially disc-shaped base and may be provided as a partition between the projectile and gunpowder received within a head of the round of less-lethal ammunition.

Alternatively, the wad may comprise a substantially disc-shaped base and a plurality of tabs extending therefrom to define a receiving zone for receiving the projectile.

The helical formation of the projectile may comprise a plurality of helical fins arranged about a rear end of a body of the projectile.

BRIEF DESCRIPTION OF THE ACCOMPANYING DRAWINGS

The invention will now further be described, by way of examples only, with reference to the accompanying diagrams wherein.

DESCRIPTION OF PREFERRED EMBODIMENTS OF THE INVENTION

Figure 1:
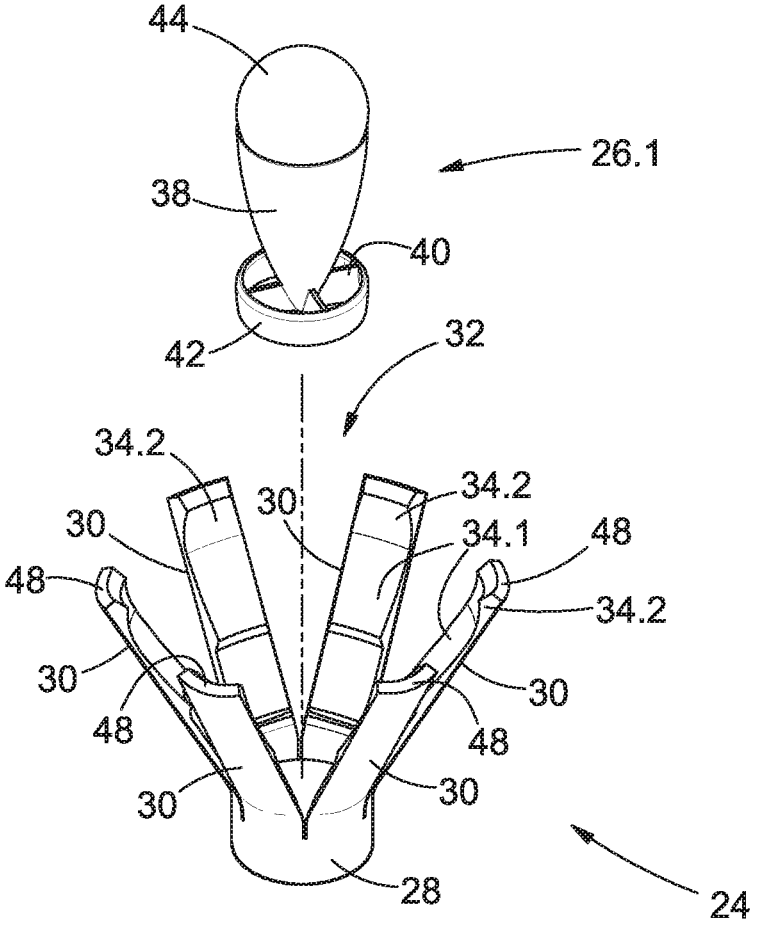
FIG. 1 is an exploded perspective view of a first example embodiment of a less-lethal projectile and a wad which is shaped to receive the less-lethal projectile in use.

A shotgun shell is generally indicated by reference numeral 10 in the figures.

The shell 10 comprises a head 12 of a metallic material such as brass. The head comprises a rim 14, for inhibiting the extent to which the shell 10 may protrude into a barrel of a shotgun (not shown). A primer 16 extends from a rear surface of the head 12, into the head 12. A volume of gunpowder 18 is received within the head 12, and at least partially surrounds the primer 16. In use, a striking pin or cock (not shown) of the shotgun strikes the primer 16, which causes the gunpowder 18 rapidly to ignite.

The shell 10 furthermore comprises a shell case 20 which extends from the head 12. The shell case 20 defines a substantially cylindrical inner cavity 22. A wad 24 is received within the inner cavity 22. The arrangement may be such that a portion of the wad 24 is received within the head 12, with the remainder of the wad 24 projecting in the shell case 20 and at least partially along the inner cavity 22.

The wad 24 defines a receiving zone (as more fully described below) within which a projectile 26 is received in use.

The wad 24 comprises a substantially disc shaped base 28 with a plurality of tabs 30 extending therefrom. In use, the tabs 30 define a receiving zone 32 therebetween. In one configuration (not shown), the disc shaped base is provided with areas of weakness or collapsible sections which are intended to absorb the shock or impact caused by the ignition of the gunpowder or other propellant, so as to protect the integrity of the projectile. In an even further configuration (not shown), an additional collapsible or shock absorbing member, with a similar shape to disk shaped base 28 is provided to be placed towards a rear end of the disc shaped base 28 so that it fits between the disk shaped base 28 and the propellant, to further shield the projectile from shockwaves emanating from the ignited gunpowder or propellant.

At least some, but typically each of the tabs 30 comprises an inwardly projecting formation 34 which, operatively, urges against the projectile 26. Typically, the wad 24 comprises six tabs 30, however, it will be understood that wads 24 comprising two or more tabs 30 may be feasible.

Figure 2:
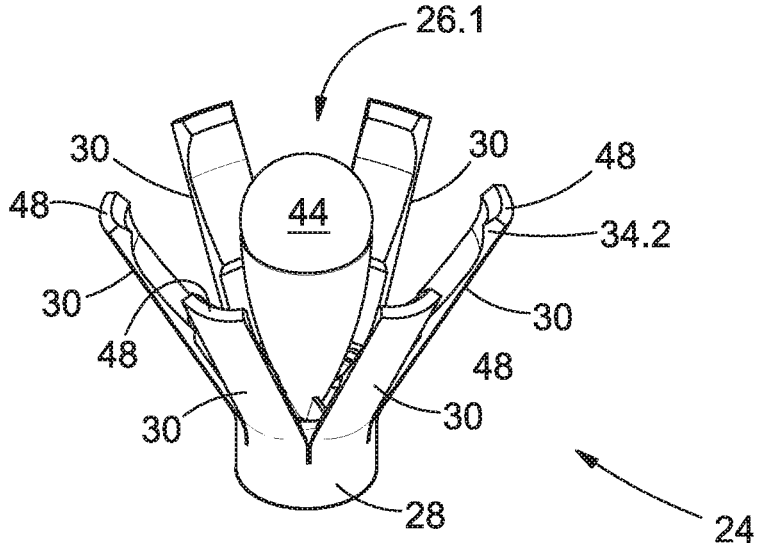
FIG. 2 is a perspective view of an assembly of the less-lethal projectile and wad of FIG. 1, wherein the less-lethal projectile is received within a receiving zone of the wad, while tabs of the wad are configured in an outward configuration.

The tabs 30 are displaceable between an inward configuration (typically shown in FIG. 3) and an outward configuration (typically shown in FIGS. 1 and 2). When the tabs 30 are configured in the first configuration, the wad 24 has a substantially cylindrical outer shape and can therefore slide into the inner cavity 22 of the shell case 20.

The tabs 30 may be integrally formed with the base 28. Towards the base 28, the tabs comprise narrowed portions 36, which on the one hand, facilitates displacement of the tabs 30 between the inward and outward configurations, and on the other hand, provide enough space for receiving the projectile 26 (as discussed more fully below). Generally, the tabs 30 are biased towards the outward configuration.

The tabs 30 furthermore each comprise a flat face 48 at an end opposite the base 28.

The inwardly projecting formation 34 comprises a first portion 34.1 which may be shaped similar to or in accordance with an intermediate portion (typically in the case of an elongate projectile 26.1 as discussed more fully below) or rearward portion (typically in the case of a substantially spherical projectile 26.2 as more fully discussed below) of the projectile 26. Therefore, when a projectile 26 is received within the receiving zone 32 and the tabs are displaced to the second configuration, the first portions 34.1 of the tabs 30 urge against the intermediate or rear portion (as the case may be) of the projectile 26.

The inwardly projecting formations 34 furthermore comprise second portions 34.2 which are shaped similarly to a profile of a front portion of the projectile 26. The front portion of the projectile 26 is typically substantially semi-spherical.

When the tabs 30 are configured in the inward configuration, and a projectile 26 is received within the receiving zone 32, the second portions 34.2 of the plurality of tabs 30 urge against the front portion of the projectile 26 thereby preventing the projectile 26 from being displaced axially relative to the wad 30. In this way, the projectile 26 is held within the wad 24 and prevented from falling therefrom.

In a first example (as shown in FIGS. 1 to 7) the projectile 26 comprises an elongate projectile 26.1 of the known kind. The elongate projectile 26.1 comprises an elongate body 38 manufactured from a polymer, typically a biodegradable plastics material. A plurality of fins 40 are radially and/or helically disposed relative to a rear portion of the body 38. The fins cause the projectile 26.1 to spin along its longitudinal axis in flight, which stabilises the projectile 26.1 in flight. An annular airfoil 42 is provided towards the rear of the body 38, and typically around the fins 40. The airfoil 42 improves the aerodynamic properties of the projectile 26.1, improves in-flight stability, and allows stacking of subsequent projectiles 26.1 in a magazine (not shown). The narrowed portion 36 is specifically provided to accommodate the airfoil, when the projectile 26.1 is received within the wad 24, and the tabs 30 are in the inward configuration.

A capsule 44 is located towards the front portion of the body 38. As shown in the figures, the capsule 44 may take the form of a conventional spherical projectile received by a front end of the body 38. In an alternative embodiment (not shown) the capsule 44 may be formed by a cap provided over an opening of the body 38. The capsule 44 contains a substance, such as a lachrymatory substance, other powders or fluids, including dyes.

In the first example of FIGS. 1 to 7, the first portions 34.1 of the tabs 30, when configured in the inward configuration, collectively define a substantially tear-shaped receiving zone for receiving the body 38 of the projectile 26.1. Simultaneously, the second portions 34.2 of the tabs 30 collectively define a substantially semi-spherical receiving zone receiving the capsule 44.

In a second example (shown in FIGS. 8 to 11) the projectile 26 comprises a substantially spherical projectile 26.2 of the known kind. Now, when the tabs 30 are in the first configuration, the first portions 34.2 collectively define a semi-spherical receiving zone, so that the first and second portions (34.1, 34.2) collectively define a substantially spherical receiving zone 32 within which to receive the substantially spherical projectile 26.2.

In a third example, which is shown in FIGS. 12 to 15, the tabs 30 comprise a second inwardly projecting formation 46 comprising a third and fourth portion (46.1, 46.2) for defining a second substantially spherical receiving zone for receiving a second substantially spherical projectile 26.2 within the wad 24.

The wad 24 is manufactured from a polymeric material, such as a plastics material. The polymeric material may be water soluble and bio-degradable.

An end portion 50 of the wad 24 is dome shaped. The dome shape of the end portion 50 aids in absorbing some of the initial shock caused by the rapidly igniting gunpowder.

Figure 3:
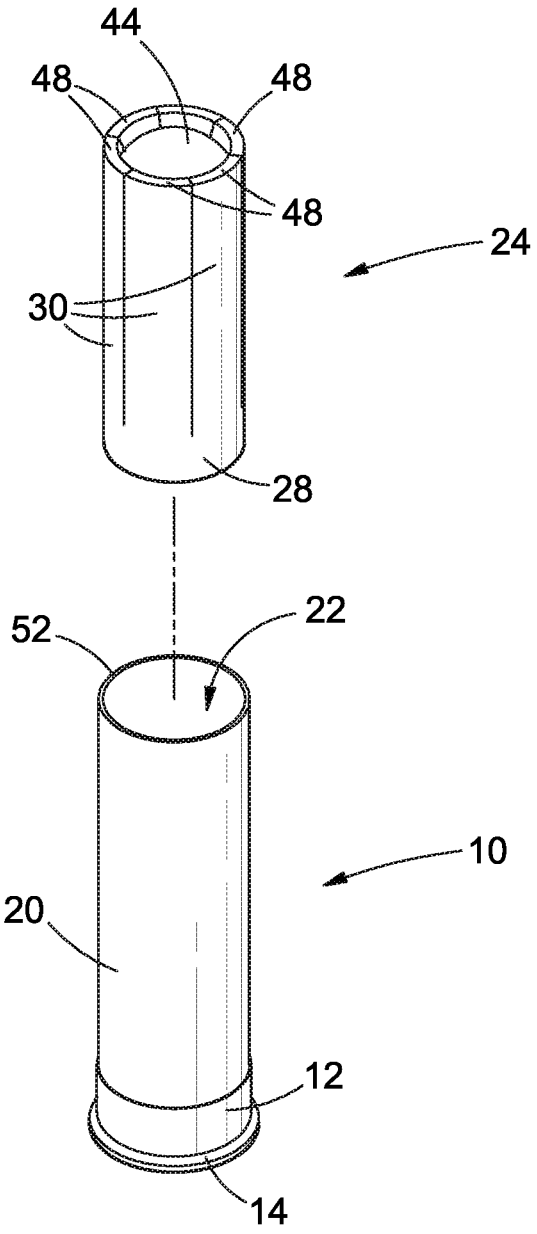
FIG. 3 is an exploded perspective view of a shotgun shell case and the assembly of FIG. 2, with the tabs displaced to an inward configuration.
Figure 4:
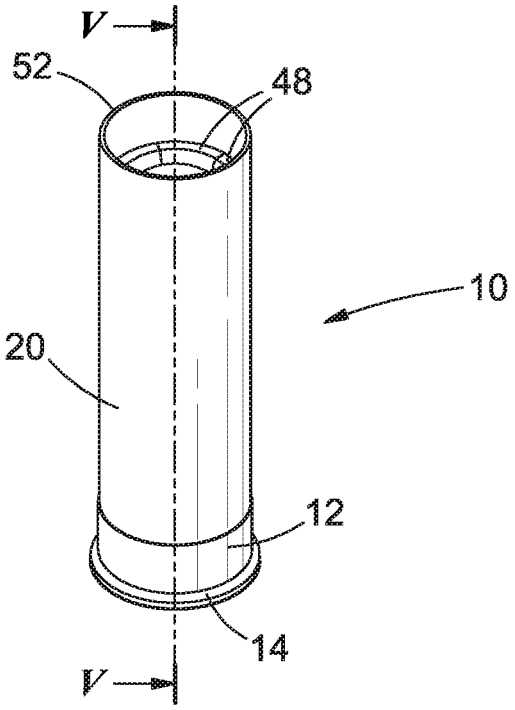
FIG. 4 is a perspective view of the shotgun shell of FIG. 3, wherein the assembly of the wad and less-lethal projectile is received within the shotgun shell case.
Figure 5:
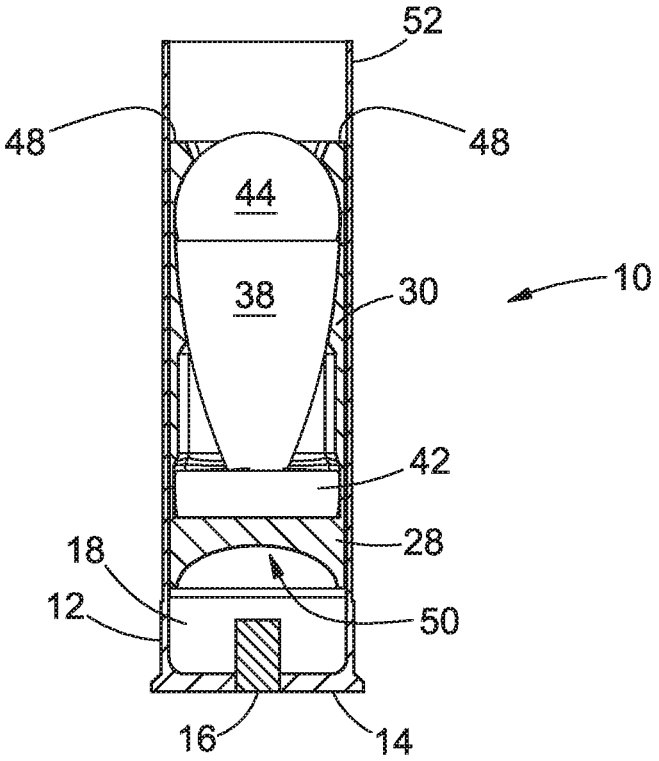
FIG. 5 is a side view of the shell of FIG. 4, sectioned along line V-V indicated in FIG. 4.
Figure 6:
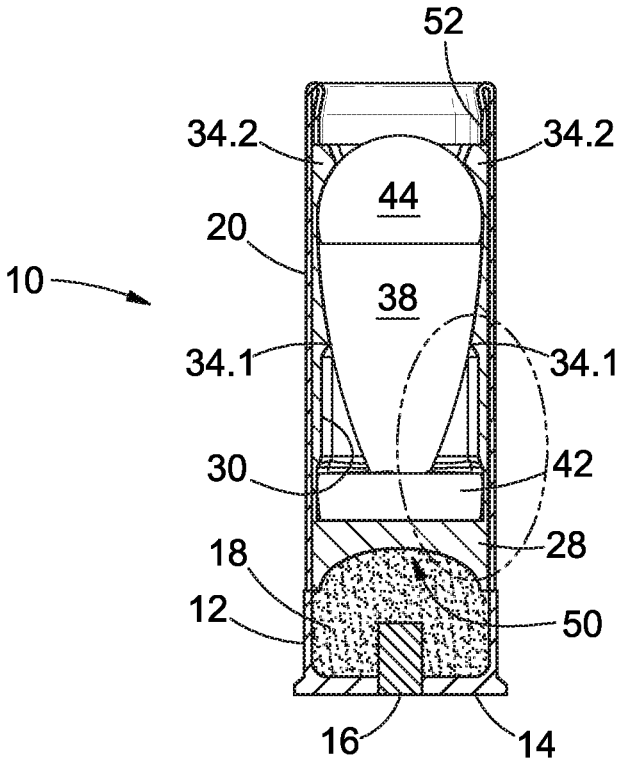
FIG. 6 is a side view of FIG. 5, wherein a mouth of the shell case has been folded over to lock the wad in position within the shell case.
Figure 7:
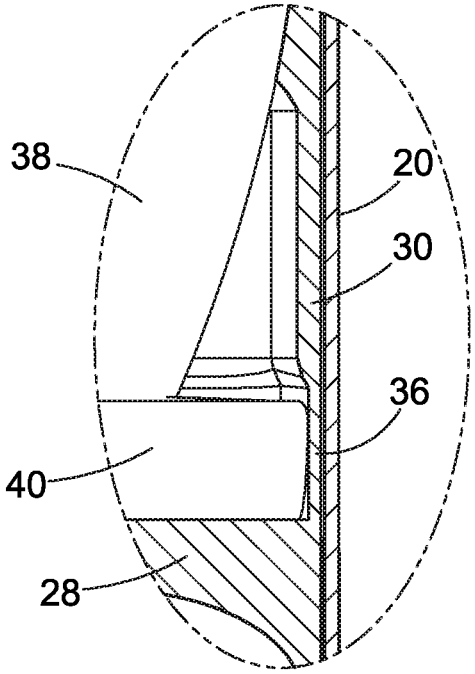
FIG. 7 is a detail view of a portion of the shell case, wad and less-lethal projectile.
Figure 8:
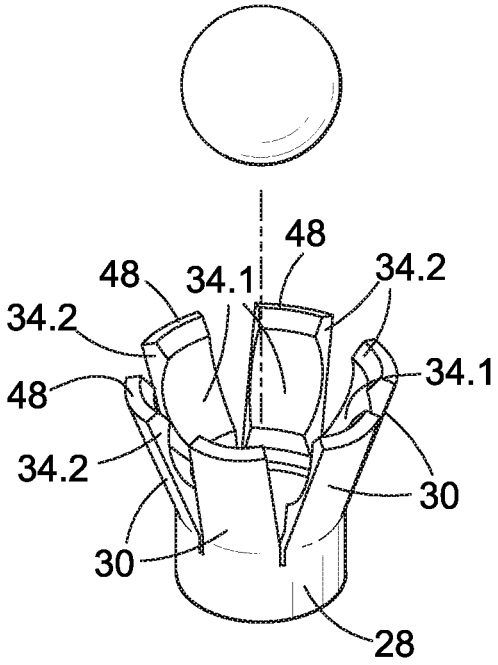
FIG. 8 is an exploded perspective view of a second example embodiment of a less-lethal projectile and a wad which is shaped to receive the less-lethal projectile in use, the less lethal projectile being substantially spherical.
Figure 9:
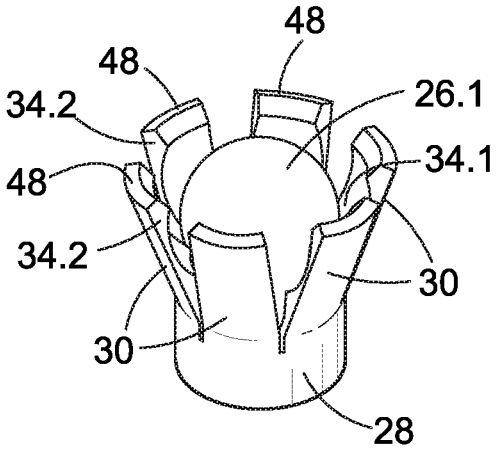
FIG. 9 is a perspective view of an assembly of the less-lethal projectile and wad of FIG. 8, wherein the less-lethal projectile is received within a receiving zone of the wad, while tabs of the wad are configured in an outward configuration.
Figure 10:
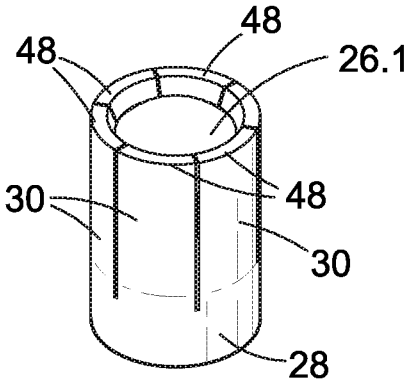
FIG. 10 is a perspective view of the assembly of FIG. 9, with the tabs displaced to an inward configuration.
Figure 11:
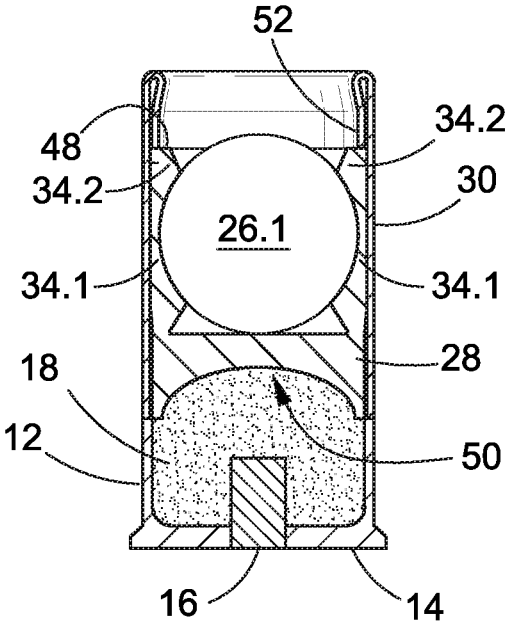
FIG. 11 is a sectioned side view of the assembly of the wad and less-lethal projectile of FIG. 10, received within a shotgun shell case.
Figure 12:
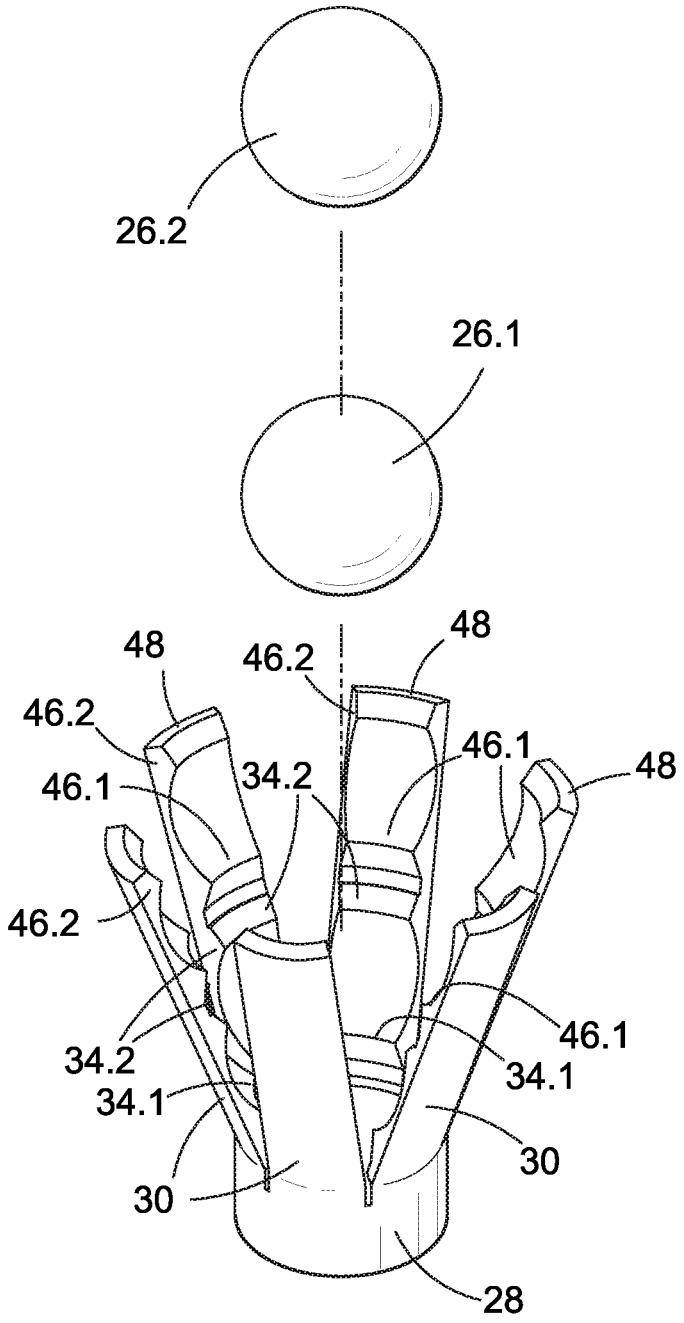
FIG. 12 is an exploded perspective view of a third example embodiment of the invention comprising a wad shaped to receive two less-lethal projectiles in use, wherein the less lethal projectiles are both substantially spherical.
Figure 13:
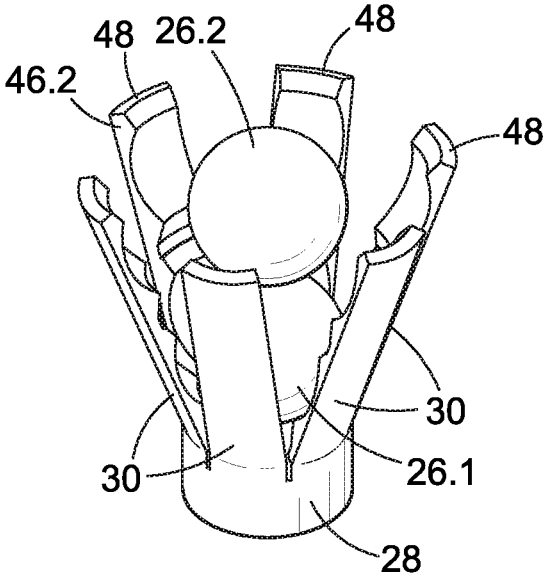
FIG. 13 is a perspective view of an assembly of the two less-lethal projectiles and wad of FIG. 12, wherein the less-lethal projectiles are received within receiving zones of the wad, while tabs of the wad are configured in an outward configuration.
Figure 14:
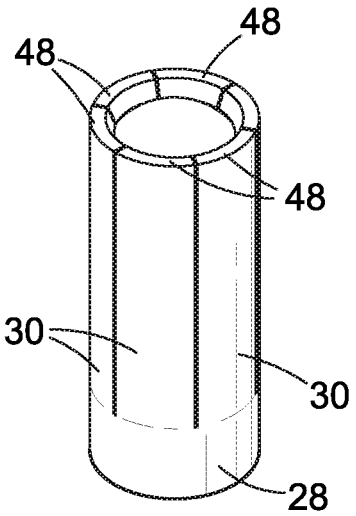
FIG. 14 is a perspective view of the assembly of FIG. 13, with the tabs displaced to an inward configuration.
Figure 15:
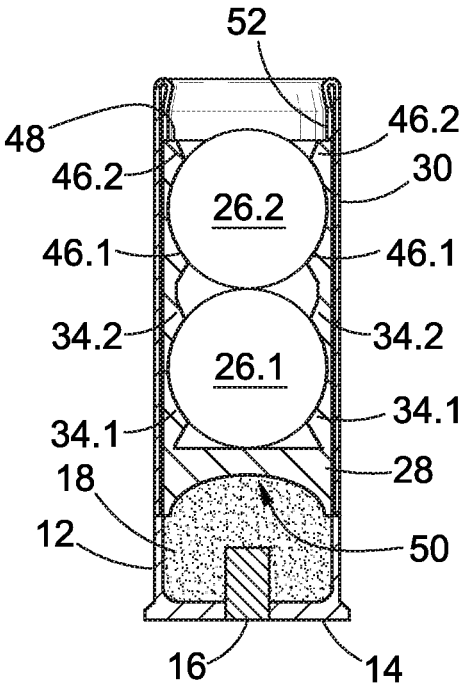
FIG. 15 is a sectioned side view of the assembly of the wad and less-lethal projectiles of FIG. 14, received within a shotgun shell case.

With reference to FIGS. 1 to 6, the shell 10 is assembled, by placing the projectile 26 into the receiving zone 32 (as indicated in FIG. 2). The placement of the projectile 26 into the receiving zone 32 is enabled by the tabs 30 naturally being biased towards the outward configuration. Next, as shown in FIG. 3, the tabs 30 are displaced against the bias to the inward configuration, so that the tabs 30 encapsulates at least the largest part of the projectile (as is shown, a front portion of the capsule 44 may project beyond the tabs 30). The wad 24 now has a substantially cylindrical outer shape, and easily slides into the cylindrical inner cavity 22 until the wad contacts the gunpowder 18 contained within the head 12 (as shown in FIG. 5). A front portion 52 of the shell case 20 is folded over on itself (as shown in FIG. 6) and contacts the flat face 48 of the wad 24, thereby inhibiting the wad from being displaced axially relative to the shell case 20. The wad 24 is therefore inhibited from falling from the shell case 20.

The shell 10 is now ready to be discharged from a shotgun (not shown). The shell is loaded into a breech (not shown) of the shotgun. When a striking pin or cock of the shotgun impacts the primer 16, the gunpowder rapidly ignites. Rapidly expanding gases within the head forces the wad 24 from the shell case 20 (the folded-over front portion 52 is therefore unfolded or forced out of the way). The dome-shaped end portion 50 therefore acts as a plunger on the one hand, propelling the wad 24 and projectile 26 assembly from the barrel, and as a shield preventing the igniting gunpowder from damaging the projectile 26, on the other.

Due to the shape of the first portions 34.1, a distributed load is transferred from the wad 24 to the projectile 26. This ensures that the projectile 26 is not damaged by the sudden force exerted on it when the gunpowder ignites. In this way, the invention enables fragile less-lethal projectiles to be fired from gunpowder-burning weapons.

As the wad 24 and projectile 26 move along the barrel of the shotgun, the barrel prevents the tabs 30 from being displaced, under the bias, to the outward configuration. As soon as the wad 24 exits the barrel, however, the bias causes the tabs 30 to be displaced towards the outward configuration. Because of the speed at which the wad 24 travels, wind resistance acts on the tabs 30, forcing the tabs 24 wide open, dramatically slowing down the wad 24, whilst the projectile 26 is allowed to proceed along its trajectory. Interaction between the fins 40 and the air now causes the projectile 26.1 to start spinning as discussed previously.

It will be appreciated that a wad 24 having tabs 30 comprising only one of the first or the second portions (34.1, 34.2) might be feasible and therefore falls within the scope of the current invention. Furthermore, it will be appreciated that some of the tabs 30 may be provided with only first portions 34.1 while other tabs 30 may be provided with only second portions 34.2.

Figure 16:
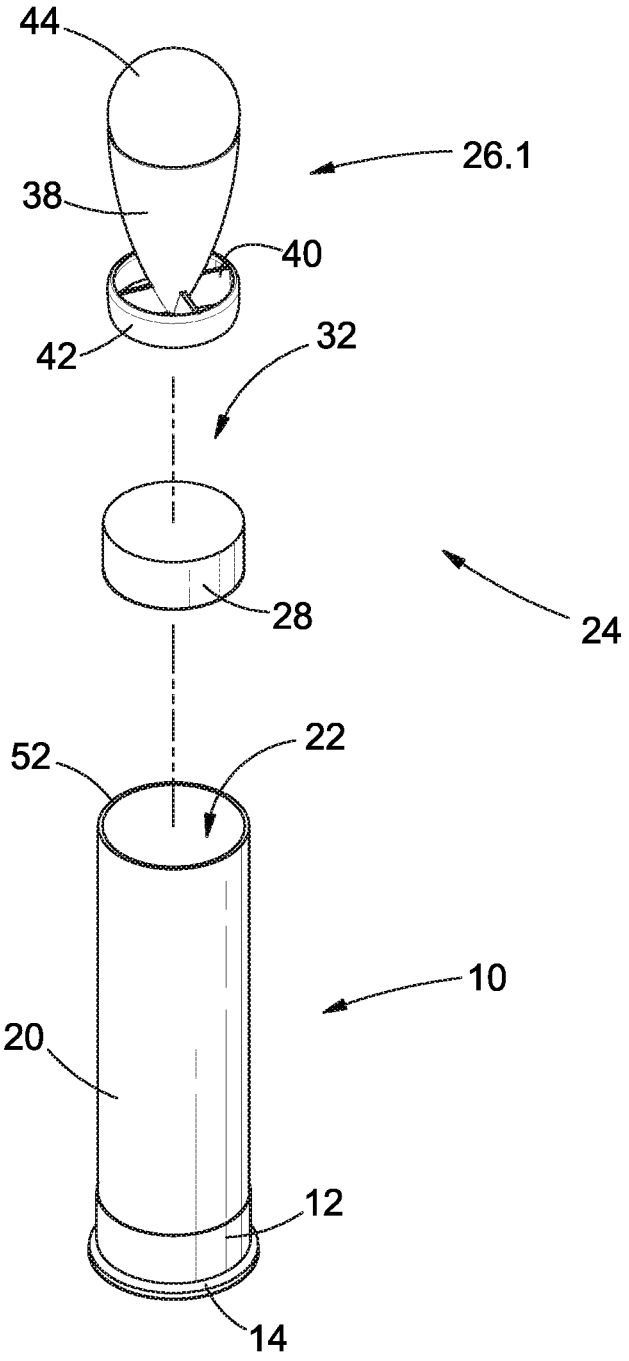
FIG. 16 is an exploded perspective view of a further example shotgun shell according to the invention comprising a wad in the form of a substantially disc-shaped base.
Figure 17:
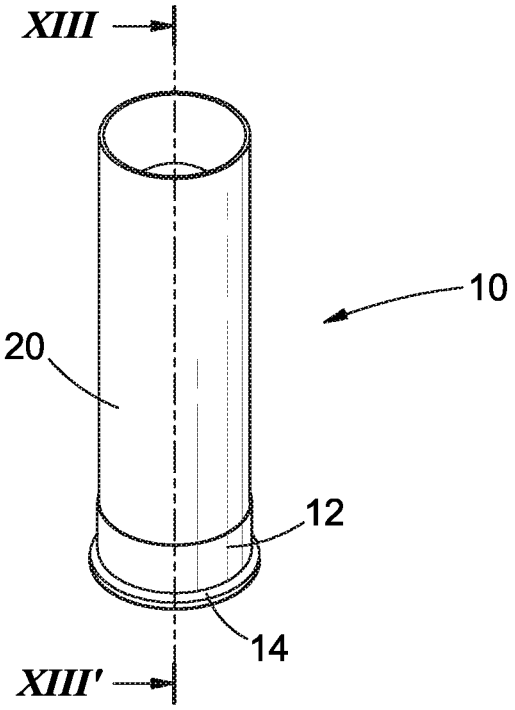
FIG. 17 is a perspective assembled view of the shotgun shell FIG. 16.
Figure 18:
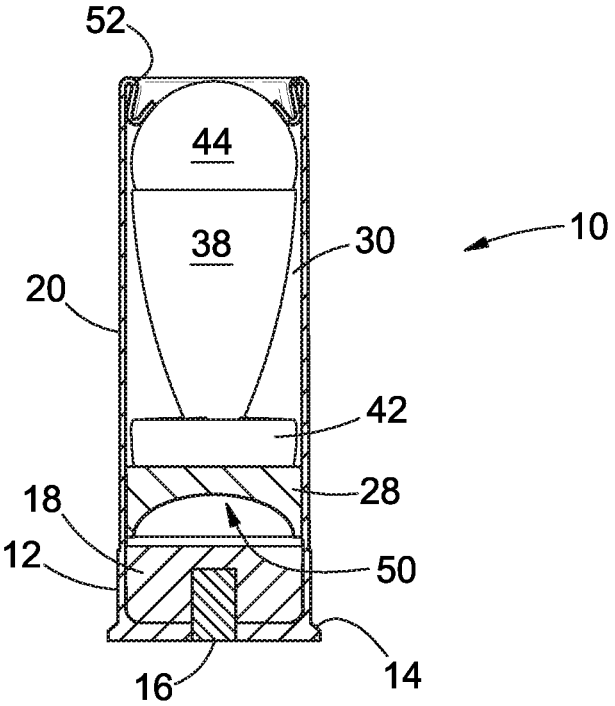
FIG. 18 is a sectioned side view of the of the shotgun shell of FIG. 17, wherein a front portion of a shell case of the shotgun shell has been folded over.

Another example embodiment of the invention is shown in FIGS. 16 to 18. Here, the wad 24 comprises only a substantially disc-shaped base 28, which serves to provide a partition between a rear portion of the projectile 26.1 and the gunpowder 18 received within the head 12. The wad 24 furthermore acts as a plunger within the substantially cylindrical inner cavity 22, for propelling the projectile 26.1 from the barrel (not shown) when the gunpowder 18 ignites. Since the projectile 26.1 comprises a helical formation (in the form of fins 40) the projectile is caused to spin in-flight after leaving the barrel. The front portion 52 may now be folded over to urge directly against the capsule 44 (as is best shown in FIG. 18).

Further alternatively (not shown), the wad 24 may comprise the substantially disc-shaped base 28 and the plurality of tabs 30 extending therefrom to define the receiving zone 32 for receiving the projectile 26.1, but the tabs 30 may exclude the formation 34.

It will be appreciated that the invention may be used and adapted to be used with projectiles of other shapes than those described herein without departing from the scope of the invention. For instance, the invention may be used with shaped projectiles 26.1 including helical fins 40, but excluding the annular airfoil 42.

It will furthermore be appreciated that, in the examples provided above, the shotgun shell could be supplemented with other known forms of firearm ammunition, such as conventional small arms, bullets, cartridges or shells, without departing from the spirit and scope of the invention. Specifically, the wad 24 and the projectile 26 may be scaled to fit within 9 mm or 40 mm cartridges of the known kind, or cartridges having other calibres.

The charge of the shotgun shell or the round of ammunition (as the case may be) may be adapted to cause the projectile 26 to be fired from the barrel (not shown) at a preselected maximum velocity.

It will furthermore be appreciated that the gunpowder 18 may be replaced by any suitable propellant such as cordite and the like.

It will be appreciated by those skilled in the art that the invention is not limited to the precise details as described herein and that many variations are possible without departing from the scope and spirit of the invention.

The description above is presented in the cause of providing what is believed to be the most useful and readily understandable description of the principles and conceptual aspects of the invention. In this regard, no attempt is made to show structural details of the invention in more detail than necessary for a fundamental understanding of the invention. The words used should therefore be interpreted as words of description rather than words of limitation.

The invention claimed is:

1. A round of less-lethal ammunition comprising:

a projectile which comprises a helical formation to operatively cause the projectile to spin in flight; and a wad operatively received within an ammunition casing, the wad comprising:

a substantially disc-shaped base; and a plurality of tabs extending from the base defining a receiving zone therebetween, with at least some of the tabs provided with an inwardly projecting formation for urging against a projectile operatively received within the receiving zone.

2. The round of less-lethal ammunition according to claim 1, wherein the wad comprises between two and ten tabs.

3. The round of less-lethal ammunition according to claim 1, wherein the tabs of the wad are displaceable between an inward configuration and an outward configuration, and comprises, towards the base, a narrowed portion to facilitate displacement between the inward and outward configurations.

4. The round of less-lethal ammunition according to claim 3, wherein the inwardly projecting formation of the tabs comprises a first portion which is shaped similarly to a profile of an intermediate or rear portion of the projectile, so that in use, when the tabs are configured in the inward configuration, the first portions of the plurality of tabs urge against the intermediate or rear portion of the projectile so that when the wad is forced from the casing, a distributed load is transferred to the intermediate or rear portion of the body of the projectile.

5. The round of less-lethal ammunition according to claim 3, wherein the inwardly projecting formation comprises a second portion which is shaped similarly to a profile of a front portion of the projectile, so that in use, the second portions of the plurality of tabs may urge against the front portion of the projectile to inhibit the projectile from being displaced axially relative to the wad when the tabs are configured in the inward configuration.

6. The round of less-lethal ammunition according to claim 3, wherein the wad is configured so that, when the tabs are configured in the inward configuration, the first portions collectively define a substantially tear-shaped receiving zone for receiving a projectile having an elongate body.

7. The round of less-lethal ammunition according to claim 1, wherein the tabs of the wad are biased towards the outward configuration.

8. The round of less-lethal ammunition according to claim 1, wherein an additional shock absorbing member is provided towards a rear end of the disc shaped base.

9. The round of less-lethal ammunition according to claim 1, wherein the ammunition casing comprises any one selected from the group consisting of shotgun shells, rifle cartridges and handgun cartridges.

10. The round of less lethal ammunition according to claim 1 comprising:

a casing defining a substantially cylindrical inner cavity;

wherein the wad projects at least partially into the substantially cylindrical inner cavity; and the projectile is received within the receiving zone of the wad.

11. The round of less lethal ammunition according to claim 10, wherein the projectile comprises an elongate body manufactured from a polymer; a capsule towards a front end of the body, the capsule for receiving a substance;

wherein the helical formation of the projectile comprise helical fins arranged relative to the body to cause the projectile operatively, to spin along a longitudinal axis of the body and an annular airfoil at the rear of the body and surrounding at least part of the fins.

12. The round of less lethal ammunition according to claim 1, wherein the helical formation of the projectile comprises a plurality of helical fins arranged about a rear end of a body of the projectile.

* * * * *